United States Patent [19]

Lucero

[11] Patent Number: 5,050,740

[45] Date of Patent: Sep. 24, 1991

[54] HARD CASE FOR CHESS EQUIPMENT

[76] Inventor: Eli Lucero, 460-B Manewal Dr., Cheyenne, Wyo. 82009

[21] Appl. No.: 575,393

[22] Filed: Aug. 28, 1990

[51] Int. Cl.[5] ..... B65D 69/00; A45C 11/00

[52] U.S. Cl. ..... 206/579; 206/315.1; 220/524; 220/529; 190/109; 190/110; 190/111; 273/285

[58] Field of Search ..... 206/315.1, 570, 576, 206/579; 220/523, 524, 526, 529; 273/260, 286, 285; 190/109, 110, 111, 112

[56] References Cited

U.S. PATENT DOCUMENTS

| | | | |
|---|---|---|---|
| 38,362 | 4/1863 | Smith | 190/111 |
| 732,983 | 7/1903 | Whitney | 190/110 |
| 775,343 | 11/1904 | Anderson | 190/111 |
| 803,732 | 11/1905 | Turner | 190/111 |
| 896,529 | 8/1908 | Gray | 190/111 |
| 1,950,252 | 3/1934 | Lewis | 190/111 |
| 2,130,762 | 9/1938 | Borden | 206/315.1 |
| 2,334,079 | 11/1943 | Feinberg | 190/111 |
| 2,346,636 | 4/1944 | Porter | 220/523 |
| 4,163,559 | 8/1979 | Stenstrom | 206/579 |
| 4,513,974 | 4/1985 | Lin | 206/579 |
| 4,817,808 | 4/1989 | Bracy | 220/524 |
| 4,842,133 | 7/1989 | LaBarge et al. | 206/579 |
| 4,972,550 | 10/1989 | Stranges | 206/315.1 |
| 4,993,717 | 2/1991 | Fiske | 273/285 |

*Primary Examiner*—David T. Fidei
*Attorney, Agent, or Firm*—Michael I. Kroll

[57] ABSTRACT

A hard case for chess equipment is provided and consists of a housing having three front compartments and a rear compartment. A lid is hinged to the housing over the three front compartments while a door is hinged to the end wall of the housing at the rear compartment. A removable padded receptacle is for protecting and storing chess pieces within the first and third front compartments. A removable tray is for protecting and storing a chess clock within the second front compartment. An elongated tube is for protecting and storing a roll up type chess board within the rear compartment. A handle is attached to one side wall of the housing for carrying the hard case from place to place. In another embodiment the housing has an enlarged compartment directly behind the other compartments with a second lid hinged thereto so that books and the like can be stored therein. A pocket is affixed to the underside of the second lid for holding various papers and the like.

12 Claims, 3 Drawing Sheets

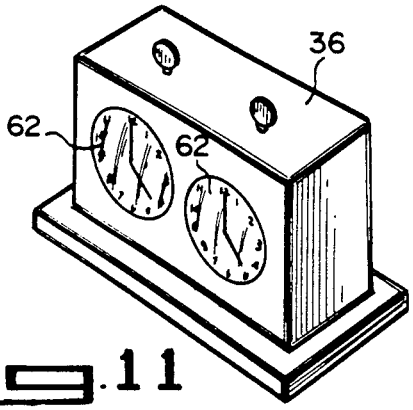
Fig. 11
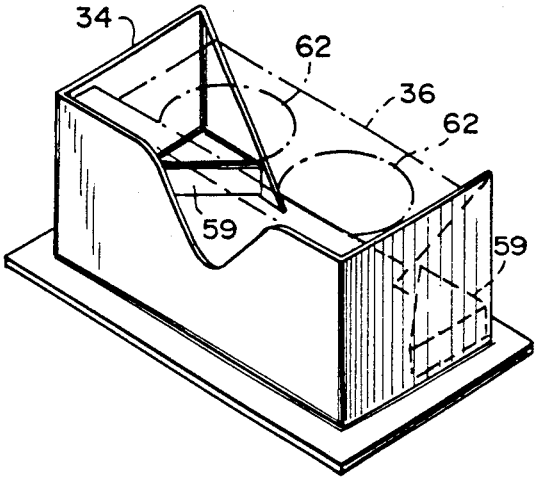
Fig. 12
Fig. 13
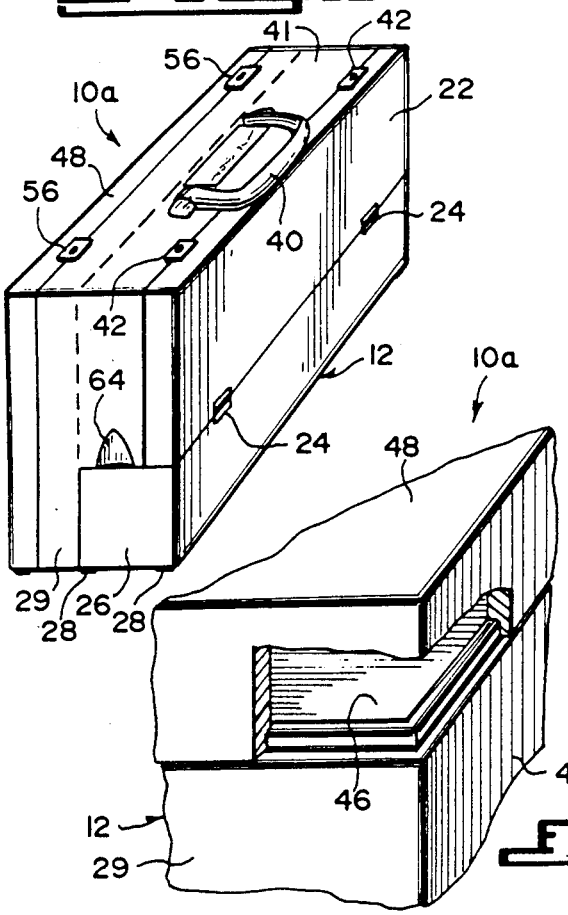
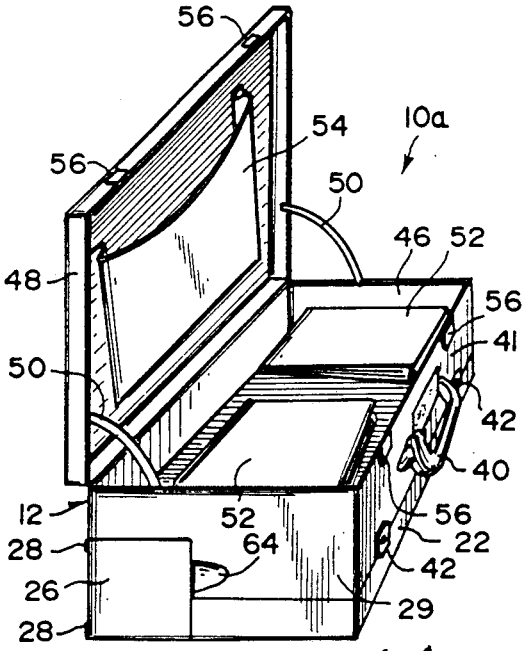
Fig. 14
Fig. 15

HARD CASE FOR CHESS EQUIPMENT

BACKGROUND OF THE INVENTION

1. Field of the Invention

The instant invention relates generally to carrying cases and more specifically it relates to a hard case for chess equipment.

2. Description of the Prior Art

Numerous carrying cases have been provided in prior art that are adapted to store various items therein so that these items can be carried from place to place conveniently. While these units may be suitable for the particular purpose to which they address, they would not be as suitable for the purposes of the present invention as heretofore described.

SUMMARY OF THE INVENTION

A primary object of the present invention is to provide a hard case for chess equipment that will overcome the shortcomings of the prior art devices.

Another object is to provide a hard case for chess equipment that is a compact and perfectly balanced case for safely storing and transporting all necessary chess equipment.

An additional object is to provide a hard case for chess equipment that will give maximum protection and prevent valuable chess equipment, such as chess clocks and good quality chess pieces, from being damaged while being carried.

A further object is to provide a hard case for chess equipment that is simple and easy to use, wherein it can perfectly fit and house everything needed for official chess tournaments, chess matches, all chess club meets and the like.

A still further object is to provide a hard case for chess equipment that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 11 is a front perspective view of a chess clock with an extended base all the way around.

FIG. 12 is a front perspective view of a fifth configuration of the tray showing the chess clock of FIG. 11 in phantom placed therein.

FIG. 13 is a perspective view of a second embodiment of the instant invention in a closed position.

FIG. 14 is a perspective view of the second embodiment of the instant invention with the second lid in an open position.

FIG. 15 is an enlarged perspective view of a corner broken away with the second lid in a closed position showing an overlap therein, typical for both lids.

DETAILED DESCRIPTION OF THE PREFERRED EMBODIMENTS

Figures 1, 1A, 2, 3, 4:
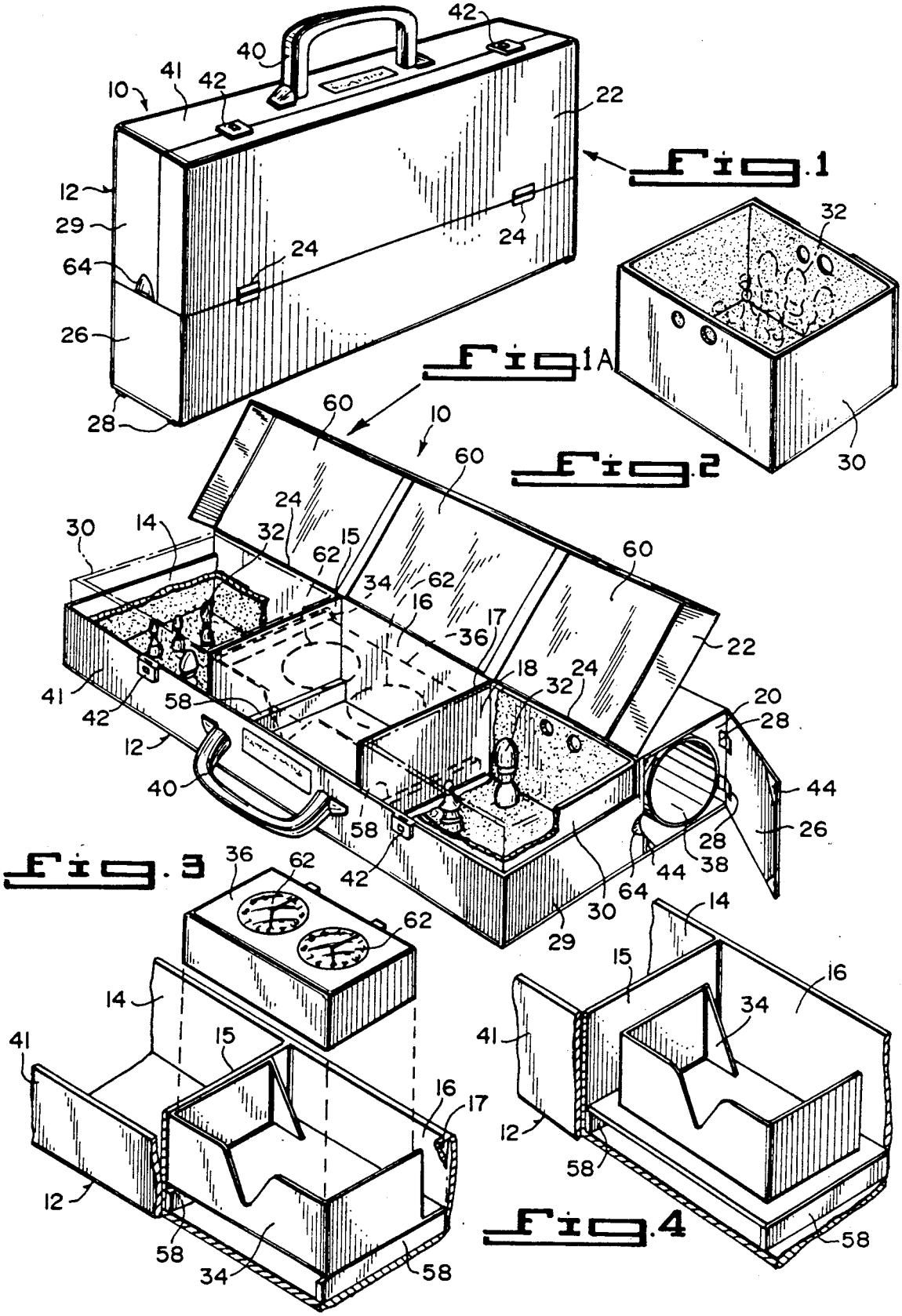
FIG. 1 is a perspective view of a first embodiment of the instant invention in a closed position.
FIG. 1A is a perspective view of the first embodiment of the instant invention in an open position with parts broken away and in phantom.
FIG. 2 is a perspective view of one of the padded receptacles.
FIG. 3 is a front perspective view of a portion of the housing with parts broken away showing a first configuration of the tray therein with a button operated chess clock removed therefrom.
FIG. 4 is a front perspective view of a portion of the housing with parts broken away showing a second configuration of the tray therein.

Turning now descriptively to the drawings, in which similar reference characters denote similar elements throughout the several views, the instant invention is a hard case 10 for chess equipment and consists of a housing 12 having three front compartments 14, 16 and 18 separated by two partitions 15 and 17, and a rear compartment 20. A lid 22 is hinged at 24 to the housing 12 over the three front compartments 14, 16 and 18. A door 26 is hinged at 28 to one end wall 29 of the housing 12 at the rear compartment 20.

Two removable padded receptacles 30 are each sized to hold, protect and store chess pieces 32 therein and are insertable into the first and third front compartments 14 and 18 in the housing 12. When each receptacle 30 is removed therefrom all the chess pieces 32 are taken out at once to allow for a quick set up of the chess pieces 32. A removable tray 34 is sized to hold, protect and store a chess clock 36 therein and is insertable into the second front compartment 16 in the housing 12. The tray 34 will hold the chess clock 36 firmly in place to prevent the chess clock 36 from moving about within the tray 34 even while the case 10 is being carried. An elongated tube 38 is sized to hold, protect and store a roll up type chess board therein and is secured within the rear compartment 20 in the housing 12. A handle 40 is attached to one side wall 41 of the housing 12 to be gripped by the hand of a person for carrying the hard case 10 from place to place.

A first latch mechanism 42 is located between the housing 12 and the lid 22 for keeping the lid 22 in a closed position when the hard case 10 is being carried. A second latch mechanism 44 which can be magnetic, is located between the end wall 29 of the housing 12 and the door 26 for keeping the door 26 in a closed position when the hard case 10 is being carried.

A second embodiment **10*a* is shown in FIGS. 13 to 14. The housing 12 has an enlarged compartment 46** directly behind the three front compartments 14, 16 and 18 and the rear compartment 20. A second lid 48 is hinged at 50 to the housing 12 over the enlarged compartment 46 so that books 52 and the like can be stored therein. A pocket 54 is affixed to the underside of the second lid 48 for holding various papers and the like. A third latch mechanism 56 is located between the housing 12 and the second lid 48 for keeping the second lid 48 in a closed position when the hard case 10*a* is being carried.

Figure 5:
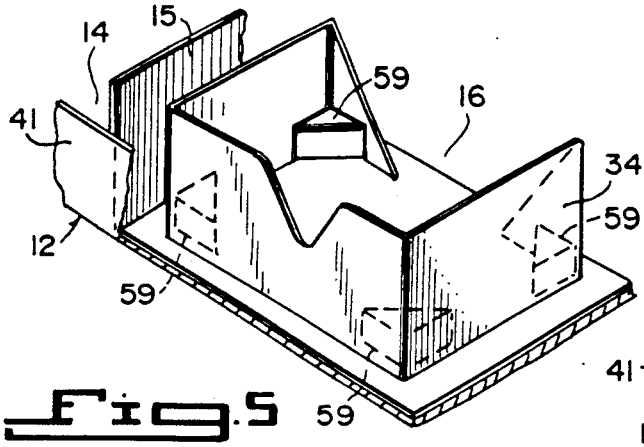
FIG. 5 is a front perspective view of a portion of the housing with parts broken away showing a third configuration of the tray therein.
Figure 6:
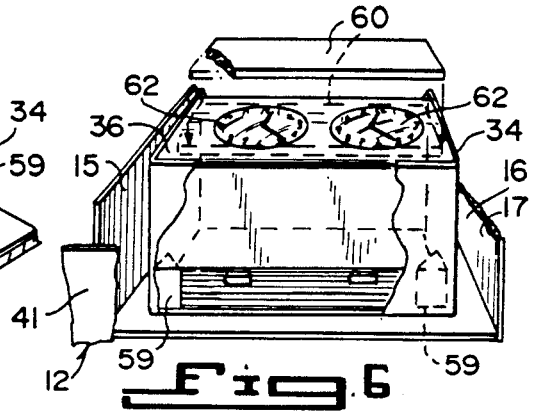
FIG. 6 is a front perspective view of a portion of the housing with parts broken away showing the third configuration of the tray therein with the button operated chess clock placed within the tray.
Figure 7:
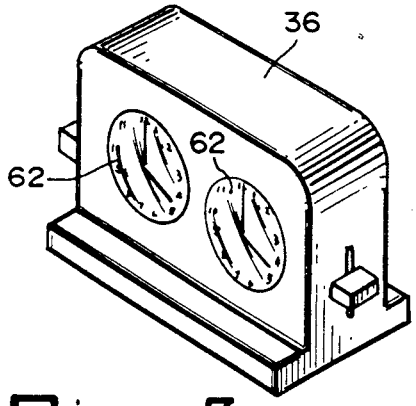
FIG. 7 is a front perspective view of a lever operated chess clock.
Figure 8:
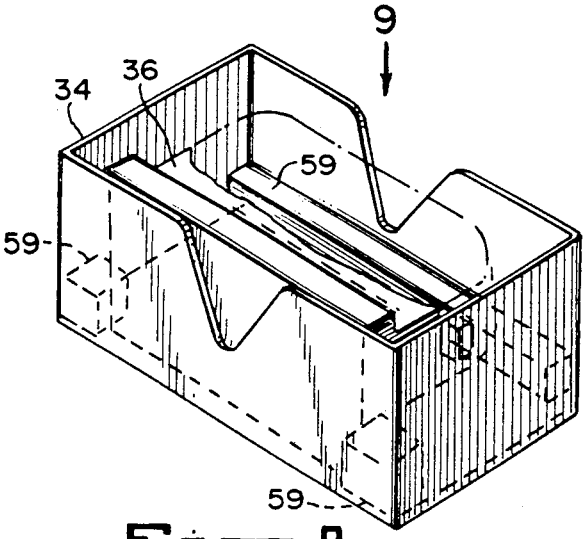
FIG. 8 is a front perspective view of a fourth configuration of the tray with the lever operated chess clock placed therein, with parts broken away and in phantom.
Figure 9:
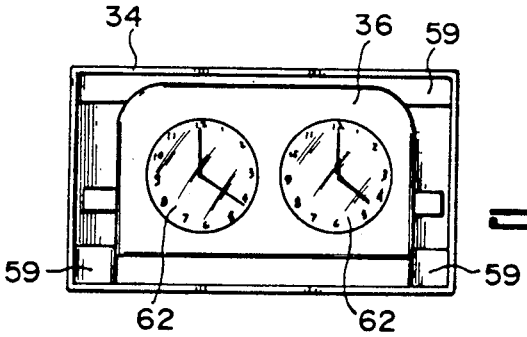
FIG. 9 is a top view of the fourth configuration of the tray with the lever operated chess clock placed therein, taken in direction of arrow 9 in FIG. 8.
Figure 10:
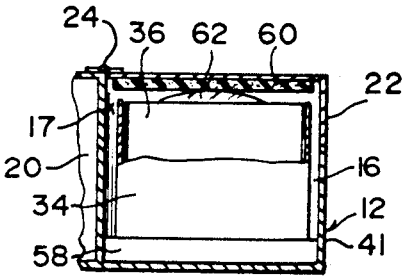
FIG. 10 is a cross sectional view taken through the chess clock compartment with the lid in a closed position.

The tray 34 can come in various configurations to accommodate various types of chess clocks 36. Removable external spacers 58, as shown in FIGS. 1A, 3, 4, and 10 can be placed under the tray 34 in the second compartment 16 so that miscellaneous items can be stored under the tray 34. Removable internal spacers 59, as shown in FIGS. 5, 6, 8, 9 and 12, can be placed within the tray 34 to protect and prevent damage to the chess clock 36. Padding 60 can be detachably secured to the underside of the lid 22 directly above the first, second and third front compartments 14, 16 and 18. The padding 60 above the second front compartment 16 can contact the top of the chess clock 36 to protect the lenses 62 of the chess clock 36, while the padding 60 above the first and second front compartments 14 and 18 can fill part of the empty space in the receptacles 30 to reduce sound and the movement of the chess pieces 32 therein. A small groove 64 is placed into the end wall 29 of the housing 12 next to the door 26 so that the door 26 can be opened therefrom to overcome the magnetic second latch mechanism 44.

The hard case 10 or 10*a* can also include, but not shown in the drawings, a compartment in the end wall 29 of the housing 12 for holding a folding chess board. A side compartment can be utilized in place of the second lid 48 for holding the folding chess board. A miscellaneous compartment can be utilized in place of the second lid 48 for holding a score book. The side compartment and the miscellaneous compartment can be combined together for holding the folding chess board and the score book. The miscellaneous compartment for holding the score book can also be attached to the underside of the first lid 22 in place of the padding 60 above the second front compartment 16.

The removable tray 34 can be eliminated and replaced by special spacers which will be inserted into the second front compartment 16 to protect and prevent damage to the chess clock 36 installed within the second front compartment.

LIST OF REFERENCE NUMBERS

10 hard case
10*a* modified hard case
12 housing
14 first front compartment in 12
15 first partition in 12
16 second front compartment in 12
17 second partition in 12
18 third front compartment in 12
20 rear compartment in 12
22 first lid
24 first lid hinge
26 door
28 door hinge
29 end wall of 12
30 removable padded receptacle
32 chess piece
34 removable tray
36 chess clock
38 elongated tube
40 handle
41 side wall of 12
42 first latch mechanism
44 second latch mechanism
46 enlarged compartment in 12
48 second lid
50 second lid hinge
52 book
54 pocket
56 third latch mechanism
58 removable external spacer
59 removable internal spacer
60 padding
62 lens of 36
64 small groove in 29

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hard case for chess equipment comprising:

a) a housing having three front compartments separated by two partitions and a rear compartment;

b) a lid hinged to said housing over the three front compartments;

c) a door hinged to one end wall of said housing at the rear compartment;

d) means for holding, protecting storing chess pieces within the first and third front compartments in said housing;

e) means for holding, protecting and storing a chess clock within the second front compartment in said housing;

f) means for holding, protecting and storing a roll up type chess board within the rear compartment; and g) means attached to one side wall of said housing, for carrying said hard case from place to place, wherein said chess pieces holding, protecting and storing means are two removable padded receptacles, each sized to hold the chess pieces therein and insertable into the first and third front compartments in said housing, so that when each said receptacle is removed therefrom all the chess pieces are taken out at once to allow for a quick set up of the chess pieces.

2. A hard case as recited in claim 1, wherein said chess clock holding, protecting and storing means is a removable tray sized to hold the chess clock therein and is insertable into the second front compartment in said housing, whereby said tray will hold the chess clock firmly in place to prevent the chess clock from moving about within said tray even while said case is being carried.

3. A hard case as recited in claim 2, wherein said roll up type chess board holding, protecting and storing means is an elongated tube sized to hold the chess board therein and is secured within the rear compartment in said housing.

4. A hard case as recited in claim 3, wherein said carrying means is a handle to be gripped by the hand of a person.

5. A hard case as recited in claim 4, further including:

a) a first latch mechanism located between said housing and said lid for keeping said lid in a closed position when said hard case is being carried; and b) a second latch mechanism located between said housing and said door for keeping said door in a closed position when said hard case is being carried.

6. A hard case as recited in claim 5 further including:

a) said housing having an enlarged compartment directly behind the three front compartments and the rear compartment;

b) a second lid hinged to said housing over the enlarged compartment so that books and the like can be stored therein; and c) a pocket affixed to the underside of said second lid for holding various papers and the like.

7. A hard case as recited in claim 6, further including a third latch mechanism located between said housing and said second lid for keeping said second lid in a closed position when said hard case is being carried.

8. A hard case as recited in claim 7, wherein said tray comes in various configurations to accommodate various types of chess clocks.

9. A hard case as recited in claim 8, further including a plurality of removable, external spaces, which are placed under said tray in the second compartment so that miscellaneous items can be stored under said tray.

10. A hard case as recited in claim 9, further including a plurality of removable internal spaces which are placed within said tray to protect and prevent damage to the chess clock.

11. A hard case as recited in claim 10, further including padding which is detachably secured to the underside of said first lid directly above the first, second and third compartments, whereby said padding above the second compartment will contact the top of the chess clock to protect the lenses of the chess clock, while said padding above the first and second compartments will fill part of the empty space in said receptacle to reduce sound and the movement of the chess pieces therein.

12. A hard case as recited in claim 11, further including a small groove placed into the end wall of said housing next to said door so that said door can be opened therefrom to overcome said second latch mechanism.

* * * * *